US011965293B2

(12) United States Patent
Norquist et al.

(10) Patent No.: US 11,965,293 B2
(45) Date of Patent: Apr. 23, 2024

(54) IMPACT ATTENUATING PATHWAY AND METHODS OF MAKING/USE

(71) Applicant: PlayCore Wisconsin, Inc., Chattanooga, TN (US)

(72) Inventors: Thomas Robert Norquist, Fort Payne, AL (US); Amy Stubley, East Aurora, NY (US)

(73) Assignee: PLAYCORE WISCONSIN , INC., Chattanooga, TN (US)

( * ) Notice: Subject to any disclaimer, the term of this patent is extended or adjusted under 35 U.S.C. 154(b) by 279 days.

(21) Appl. No.: 17/160,767

(22) Filed: Jan. 28, 2021

(65) Prior Publication Data

US 2021/0230816 A1 Jul. 29, 2021

Related U.S. Application Data

(60) Provisional application No. 62/967,146, filed on Jan. 29, 2020.

(51) Int. Cl.
*E01C 15/00* (2006.01)

(52) U.S. Cl.
CPC ..... *E01C 15/00* (2013.01)

(58) Field of Classification Search
CPC ..... E01C 15/00
USPC ..... 404/17–31, 72, 75, 32
See application file for complete search history.

(56) References Cited

U.S. PATENT DOCUMENTS 2,871,774 A * 2/1959 Johnson ..... E01C 13/065 427/139
3,022,712 A * 2/1962 Cousino ..... E01C 13/045 267/152
3,661,687 A * 5/1972 Spinney, Jr. ..... E01C 13/08 428/17
3,801,421 A * 4/1974 Allen ..... E01C 13/08 528/80
3,915,581 A * 10/1975 Copp, Jr. ..... E01C 7/00 404/32
4,420,513 A * 12/1983 Coke ..... B05D 7/24 427/407.1
4,557,475 A * 12/1985 Donovan ..... A63C 19/04 428/17
4,564,310 A * 1/1986 Thelen ..... E01C 13/02 404/31
5,020,936 A * 6/1991 Malmgren ..... E01C 13/065 404/31
5,234,738 A * 8/1993 Wolf ..... E01C 13/045 428/44

(Continued)

*Primary Examiner* — Raymond W Addie
(74) *Attorney, Agent, or Firm* — McAndrews, Held & Malloy, Ltd.

(57) ABSTRACT

The present disclosure is directed to impact-attenuating pathways that can be easily installed in outdoor areas, such as an outdoor area associated with a senior or assisted living facility. The impact attenuating pathways of the present disclosure provide a natural looking path having impact attenuation properties that can help prevent life threatening injuries. In addition to the impact attenuation properties, the pathway is configured to withstand regular wear from shoes, canes, crutches, and the like. The impact-attenuating pathway comprises a firm base layer, such as concrete; a cushion layer positioned on top of the base layer; and a wear layer positioned on top of the cushion layer.

20 Claims, 4 Drawing Sheets

(56) References Cited

U.S. PATENT DOCUMENTS

| | | | | |
|---|---|---|---|---|
| 5,514,722 | A * | 5/1996 | Di Geronimo | C08L 9/00 524/871 |
| 5,525,416 | A * | 6/1996 | Katz | B32B 25/10 428/323 |
| 5,749,787 | A * | 5/1998 | Jank | E01C 13/065 404/32 |
| 6,786,674 | B1 * | 9/2004 | Hanks | E01C 13/065 404/82 |
| 7,029,744 | B2 * | 4/2006 | Horstman | B32B 27/38 52/DIG. 9 |
| 2009/0245936 | A1 * | 10/2009 | Jones | E02D 31/004 442/195 |
| 2010/0124633 | A1 * | 5/2010 | Sacks | E01C 13/065 427/136 |
| 2016/0138228 | A1 * | 5/2016 | Rainwater | E01C 19/16 404/111 |
| 2017/0081807 | A1 * | 3/2017 | Tetrault | B32B 25/00 |
| 2019/0003132 | A1 * | 1/2019 | Yu | A41G 1/009 |

* cited by examiner

IMPACT ATTENUATING PATHWAY AND METHODS OF MAKING/USE

This application claims priority to U.S. Provisional Patent Application No. 62/967,146, filed Jan. 29, 2020, the entirety of which is incorporated by reference herein.

BACKGROUND

It is advantageous for those living at senior living facilities or assisted living facilities to remain active and to enjoy an outdoor environment. Indeed, many such facilities have designated outdoor walking and garden areas. However, the pathways in those areas are typically nothing more than conventional concrete or asphalt, e.g. sidewalks, or natural material, e.g. earth, pathways. Accordingly, if a person, and particularly a senior, falls while using the pathway, injuries are common. In some cases, such as where a fall involves a head impact, those injuries can be life threatening.

SUMMARY OF THE INVENTION

Embodiments of the present disclosure are directed to an impact attenuating pathway that can be and/or are installed in outdoor areas, such as an outdoor area associated with a senior or assisted living facility. The impact attenuating pathways of the present disclosure provide a natural looking walking path/surface having impact attenuation properties that can help prevent life threatening injuries.

Embodiments of the impact attenuating pathway or sidewalk may comprise a firm base layer, such as concrete or asphalt; a cushion layer positioned on top of the base layer; and a wear layer positioned on top of the cushion layer.

Embodiments of the impact attenuating pathways may also configured to transition substantially seamlessly into the surrounding environment, such that they do not create sharp edges that might cause one to trip and fall and/or that can be problematic for a user in a wheelchair. For example, embodiments of the impact attenuating pathway of the present disclosure comprise a first side edge and a second side edge, each of which is angled less than 70°, alternatively less than 65°, alternatively less than 60° with respect to an adjacent ground surface. Each of the first and second side edges may also be angled greater than 5°, alternatively greater than 10°, alternatively greater than 20°, alternatively greater than 30° with respect to the adjacent ground surface, e.g., so as to avoid extending deep into the surrounding landscaping. In some embodiments, for example, each of the first and second side edges may be angled between 70° and 10°, alternatively between 65° and 20°, alternatively between 60° and 30° with respect to an adjacent ground surface.

In order to provide the pathway with a consistent feel (e.g. hardness, springiness, etc.) between the planar top surface and the transition regions, each of the base layer, the cushion layer, and the wear layer may comprises a first side edge and a second side edge, each of which is angled less than 70°, alternatively less than 65°, alternatively less than 60° with respect to a ground surface adjacent to the pathway. Each of the first and second side edges may also be angled greater than 5°, alternatively greater than 10°, alternatively greater than 20°, alternatively greater than 30° with respect to the adjacent ground surface, e.g., so as to avoid extending deep into the surrounding landscaping. In some embodiments, for example, the first and second side edges of each of the base layer, the cushion layer, and the wear layer may be angled between 70° and 10°, alternatively between 65° and 20°, alternatively between 60° and 30° with respect to an adjacent ground surface.

In some embodiments, a ground surface adjacent at least a portion of one of the first and second side edges of the impact attenuating pathway may comprise loose fill material such as soil, mulch, gravel, or the like. The loose fill material may at least partially (and optionally completely) cover the transition regions formed by the angled side edges.

The top surface of the impact attenuating pathway, e.g. the top surface of the wear layer, may be substantially planar with the adjacent ground surface. Generally, it is desirable that this be inclusive of any loose fill material that may be present on the ground surface. In this way, embodiments of the impact attenuating pathway of the present disclosure provide little to no curb.

The impact attenuating pathway may further comprising a crushed stone layer positioned below the base layer. The entireties of the base layer, cushion layer, and wear layer may be positioned above the crushed stone layer. For instance, the angled side edges of the pathway may be positioned entirely above the crushed stone layer. The crushed stone layer may comprises a first side edge and a second side edge, each of which are substantially perpendicular with respect to a ground surface adjacent to the pathway.

In some embodiments of the impact attenuating pathway, the combined thickness of the base layer, cushion layer, and wear layer may be at least 5 inches, alternatively at least 6 inches, alternatively at least 6.5 inches, alternatively at least 6.75 inches, alternatively at least 7 inches.

In some embodiments, the cushion layer may have a thickness between an upper surface and a lower surface that is at least 1.5 inches, alternatively at least 1.75 inches, alternatively at least 2.0 inches, alternatively at least 2.25 inches. For example, the cushion layer may have a thickness between an upper surface and a lower surface that is between 1.5 inches and 3 inches, alternatively between 1.5 inches and 2.75 inches, alternatively between 1.5 inches and 2.5 inches, alternatively between 1.75 inches and 3 inches, alternatively between 1.75 inches and 2.75 inches, alternatively between 1.75 inches and 2.5 inches, alternatively between 2 inches and 3 inches, alternatively between 2 inches and 2.75 inches, alternatively between 2 inches and 2.5 inches. The thickness of the cushion layer may be selected to provide a desired degree of impact attenuation.

In some embodiments, the wear layer may have a thickness between an upper surface and a lower surface that is at least 0.25 inches, alternatively at least 0.4 inches, alternatively at least 0.5 inches. For example, the wear layer may have a thickness between an upper surface and a lower surface that is between 0.4 inches and 1 inch, alternatively between 0.4 inches and 0.75 inches, alternatively between 0.4 inches and 0.5 inches, alternatively between 0.5 inches and 1 inch, alternatively between 0.5 inches and 0.75 inches. The thickness of the wear layer may be selected to provide a desired degree of wear resistance (e.g. from shoes and mobility devices).

In some embodiments, the base layer may have a thickness between an upper surface and a lower surface that is at least 2 inches, alternatively at least 3 inches, alternatively at least 4 inches. The thickness of the base layer may be selected to provide a desired degree of support. In some embodiments, the base layer may be concrete or asphalt, such as a concrete having a compressive strength of at least 3,500 psi, alternatively a concrete having a compressive strength of at least 4,000 psi.

The cushion layer of embodiments of the impact attenuating pathway may comprise, consist essentially of, or consist of a blend of a rubber component and a binder. In some embodiments, the rubber component may comprise rubber chunk, tire buffings, or a combination thereof. In some embodiments, the rubber component may be at least 50% rubber chunk, alternatively at least 75% rubber chunk, alternatively 100% rubber chunk. In some embodiments, the rubber component may have a mean Shore A durometer less than 80, alternatively less than 75, alternatively less than 70. In some embodiments, the rubber component may comprise styrene butadiene rubber, EPDM, nitrile/NBR, natural rubbers, or any combination thereof. The binder may be, for example, polyurethane. The binder may make up between 4% and 10% of the blend, alternatively between 5% and 9% of the blend, alternatively between 6% and 8% of the blend, for example.

The wear layer of embodiments of the impact attenuating pathway may comprise, consist essentially of, or consist of a blend of rubber granules and a binder. The rubber granules may be significantly smaller than the rubber component of the cushion layer. In some embodiments, the rubber granules may be sized between 1 and 4 mm, alternatively between 1 and 3.5 mm. The rubber granules may comprise or consist of thermoplastic vulcanizates (TPV) granules. The binder may be, for example, polyurethane. The binder may make up between 15% and 25% of the wear layer blend, alternatively between 16% and 24%, alternatively between 17% and 23% of the wear layer blend, alternatively between 17% and 22% of the wear layer blend, for example.

The impact attenuating pathway may be configured to achieve a Head Injury Criterion (HIC) score less than 750 (at each of three temperatures: −6° C., 23° C., and 49° C.), alternatively less than 700, alternatively less than 650, alternatively less than 600, alternatively less than 550, at a cushion layer thickness of 2.0 inches or less and a wear layer thickness of 0.75 inches or less, as tested by ASTM F1292-18 at a specified impact height of 4 feet.

The impact attenuating pathway may be configured to withstand regular wear from shoes, canes, crutches, and the like without requiring replacement over a period of at least 5 years, alternatively at least 6 years, alternatively at least 7 years, alternatively at least 8 years, alternatively at least 9 years, alternatively at least 10 years.

Embodiments of the present disclosure are also directed to methods of attenuating the impact of a person falling. The method comprises providing an outdoor area, such as an outdoor area associated with a senior or assisted living facility, with an embodiment of the impact attenuating pathway or sidewalk described herein.

More particularly, in some embodiments the method may comprise: installing the base layer; blending the rubber component and the binder to produce a pourable cushion layer; pouring the cushion layer in place over the base layer and spreading to produce a substantially uniform and even layer; and installing the wear layer. The step of installing the wear layer may comprise blending the rubber granules and the binder to produce a pourable wear layer and pouring the wear layer in place over the cushion layer and spreading to produce a substantially uniform and even layer.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Though developed from similar materials as playground surfaces, the impact attenuating pathways of the present disclosure have been created and designed to operate as pathways upon which users walk, e.g. sidewalks, and in particular pathways for installation and use in senior and assisted living facilities. For instance, embodiments of the impact attenuating pathways are configured both to withstand repeated traffic from mobility devices (e.g. canes, crutches, walkers, wheelchairs, etc.) and to provide a soft landing surface that prevents injuries, and in particular severe head injuries. Embodiments of the impact attenuating pathways are also configured to transition substantially seamlessly into the surrounding environment, such that they do not create sharp edges that might cause one to trip and fall and/or that can be problematic for a user in a wheelchair.

In some embodiments, the impact attenuating pathway may be configured to provide a degree of impact attenuation performance characterized by a Head Injury Criterion or HIC score. The Head Injury Criterion or HIC score is an empirical measure of impact severity based on published research describing the relationship between the magnitude and duration of impact accelerations and the risk of head trauma. The HIC score of a surface is measured in accordance with the standards set out in ASTM F1292-18 (Rev. 6, Effective Date 2018-1-25), which specifies impact attenuation performance requirements for playground surfaces and surfacing materials. In particular, ASTM F1292-18 provides a means of determining impact attenuation performance using a test method that simulates the impact of a person's head with the surface. Although developed for playground surfaces, the present inventors have determined that the same impact attenuation performance testing can also advantageously be used in the context of the impact attenuating pathways of the present disclosure.

For example, in some embodiments, the pathway may be capable of achieving a Head Injury Criterion (HIC) score less than 750 (at each of three temperatures: −6° C., 23° C., and 49° C.), alternatively less than 700, alternatively less than 650, alternatively less than 600, alternatively less than 550, at a cushion layer thickness of 2.0 inches or less and a wear layer thickness of 0.75 inches or less, as tested by ASTM F1292-18 at a specified impact height of 4 feet.

Figure 1:
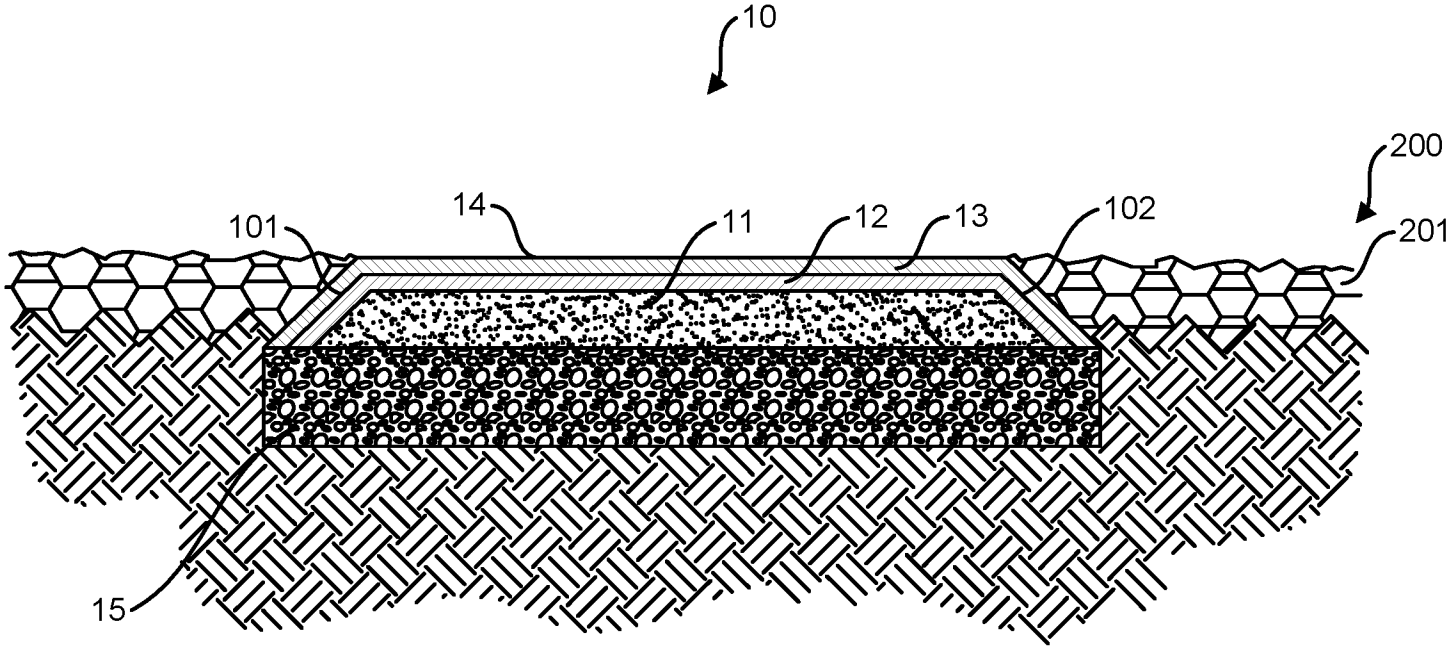
FIG. 1 is a cross-sectional elevation view of an impact attenuating pathway of according to an embodiment of the present disclosure.
Figure 2:
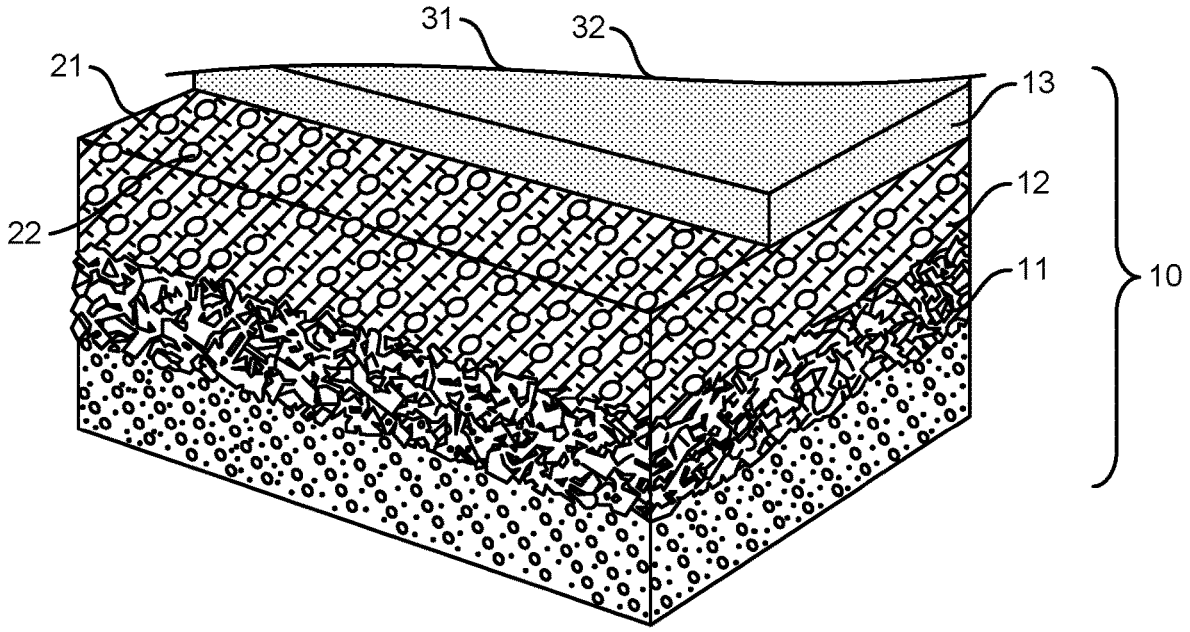
FIG. 2 is a cross-sectional elevation view of an impact attenuating pathway according to an embodiment of the present disclosure, showing each of a base layer, cushion layer, and wear layer.

Embodiments of impact attenuating pathways 10 are shown in cross-section in FIGS. 1 and 2. As shown in those figures, embodiments of the present disclosure are directed to an impact attenuating pathway 10 that comprises a firm base layer 11, such as concrete or asphalt; a cushion layer 12 positioned on top of the base layer; and a wear layer 13 positioned on top of the cushion layer. The thicknesses of the various layers may be selected to achieve a desired combination of impact attenuation and wear resistance. In some embodiments, for instance, the cushion layer 12 lay be at least 2.0 inches thick and the wear layer 13 may be at least 0.5 inches thick.

In some embodiments, the base layer 11 is concrete, desirably a concrete having a compressive strength of at least 3,500 psi, alternatively a concrete having a compressive strength of at least 4,000 psi. The concrete should be thick enough to provide a rigid support onto which the cushion and wear layers can be installed. This base layer 11 provides the impact attenuating pathway with the sturdiness and feel of a conventional walkway such as a sidewalk. The base layer 11 also serves to allow the pathway to withstand the forces that will be placed on it by serving as a high-frequency walkway over an extended period of time.

In some embodiments, the cushion layer 12 may be a blend of rubber component 21 and a binder 22. The rubber component 21 may desirably have a mean Shore A durometer less than 75. The rubber component 21 may include any of the types of rubber materials used in poured-in-place playground surfaces. For instance, the rubber component may be rubber chunk 23, e.g. such as that shown in FIG. 3, tire buffings 24, e.g. such as that shown in FIG. 4, or any combination thereof. Because rubber chunk 23 is typically softer than tire buffings 24, it may be desirable that the rubber component 21 consist predominantly or entirely of rubber chunk. The rubber chunk 23 may be made up of granules of reclaimed rubber scrap. Accordingly, the rubber chunk 23 may include a mixture of different rubber materials. Those rubber materials may include, for example, styrene butadiene rubber (SBR), ethylene propylene diene monomer rubber (EPDM), nitrile/nitrile butadiene rubbers (NBR), and natural/latex rubbers.

Figure 3:
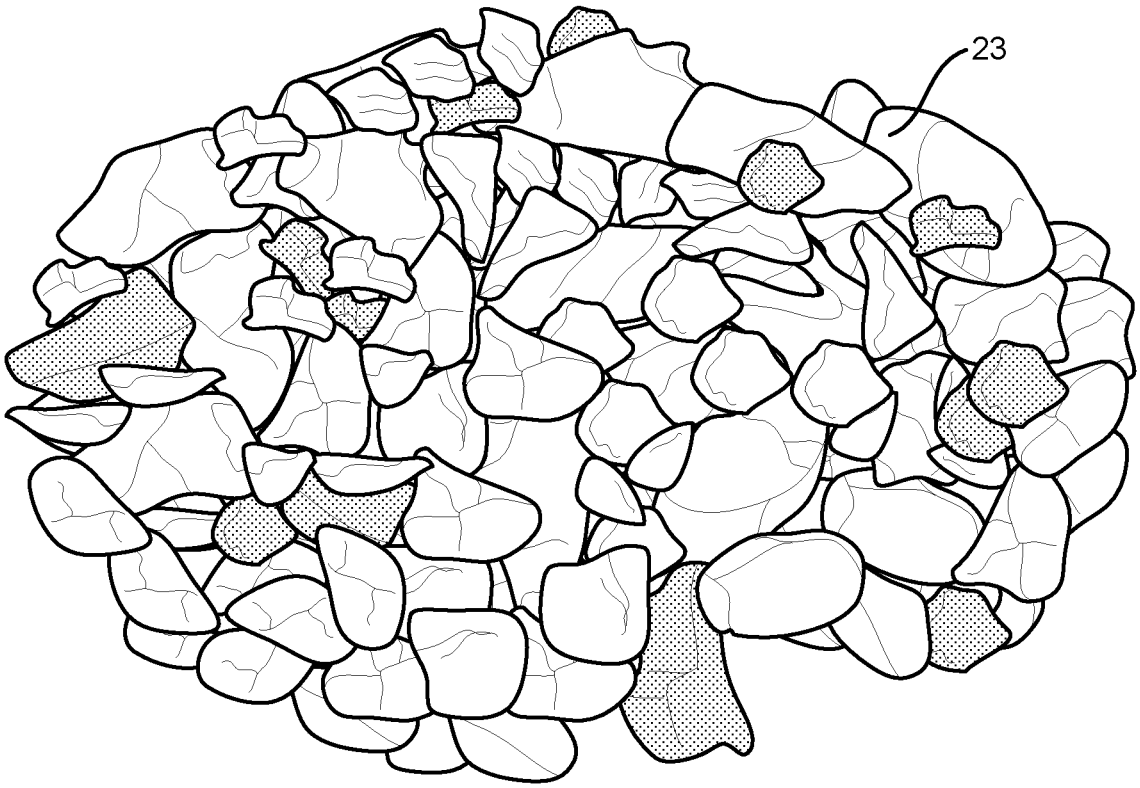
FIG. 3 shows an example of a chunk component used in embodiments of the cushion layer described herein.

As shown in FIG. 3, the granules that make up the rubber chunk 23 may be of irregular sizes and shapes. In some embodiments, the granules may be processed so as to provide some degree of size uniformity. For instance, the granules may be run through one or more filters in order to remove granules above a certain size. For example, the granules may all have at least one dimension with a maximum cross-section of less than one inch. In some embodiments, for instance, the granules may be filtered using a ⅝ inch filter. As such, the granules may all have at least one dimension with a maximum cross-section of ⅝ inch or less. In other embodiments, the granules may be filtered using ½ inch filter (producing granules having at least one dimension with a maximum cross-section of ½ inch or less), ⅜ inch filter (producing granules having at least one dimension with a maximum cross-section of ⅜ inch or less), ¾ inch filter (producing granules having at least one dimension with a maximum cross-section of ¾ inch or less), ⅞ inch filter (producing granules having at least one dimension with a maximum cross-section of ⅞ inch or less), or the like.

Figure 4:
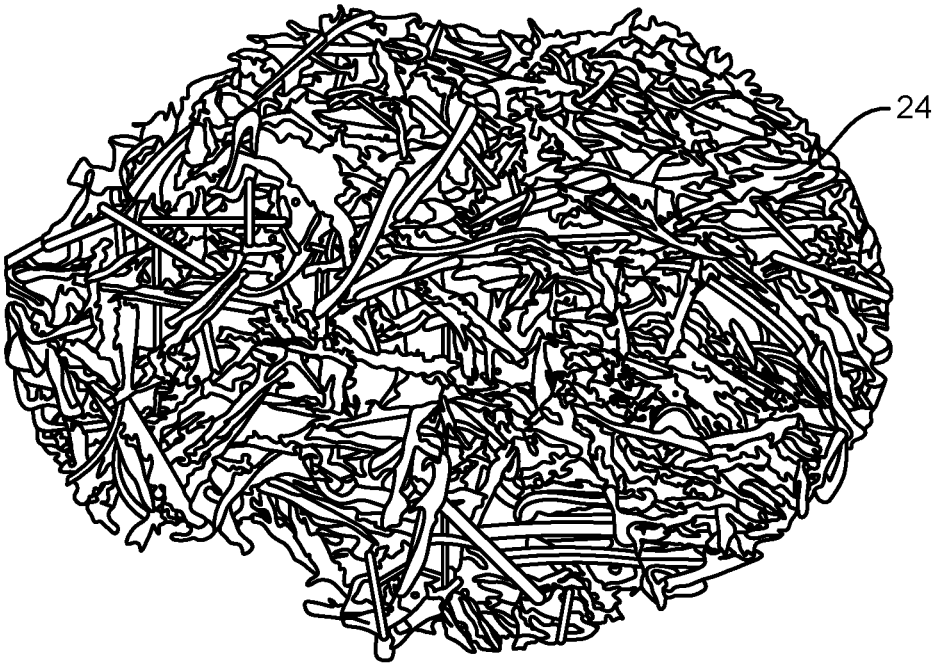
FIG. 4 shows an example of a tire buffings component used in embodiments of the cushion layer described herein.

As shown in FIG. 4, tire buffings 24 are generally elongated, i.e. fiber-like, strands made up predominantly of styrene butadiene rubber (SBR). These strands are recycled tire rubber, typically obtained from the process of re-capping commercial truck tires. In some embodiments, the strands may have a thickness between about 0.5 mm and about 2.0 mm and a length between about 3.0 mm and about 20.0 mm. The strands may generally have an aspect ratio (length to width) of at least 3, alternatively at least 5, alternatively at least 7.

The binder 22 may be any suitable polymeric binding material. In many embodiments, the binder 22 may be polyurethane. Notably, in order to provide a firmer surface that is better suited to a pathway configured for use by seniors, the ratio of binder 22 to rubber component 21 may typically be greater than that used in playground surfaces.

The rubber component 21 and the binder 22 may be blended together to create a pourable cushion layer 12 material. The blending may be performed using conventional equipment, such as a rotating tumbler. Once the components are sufficiently blended, the blend may be poured into a cavity in a conventional manner, such as through the use of a pouring cart or wheel-barrow. The poured blend may then be spread, e.g. through hand troweling, to produce a cushion layer having a substantially consistent thickness and a smooth, even finish. As the binder 22 dries and hardens, the cushion layer 12 becomes set. The thickness of the cushion layer 12 may be selected to provide a desired degree of fall protection, i.e. impact absorption.

In some embodiments, the wear layer 13 may also be a blend of rubber granules 31 and a binder 32. In some embodiments, for example, the wear layer 13 may comprise thermoplastic vulcanizates, such as those sold by RoseHill Polymers Group under the commercial designation TPV, or another treated rubber, blended with a polyurethane binder. The rubber granules 31 used in the wear layer 13 may generally be smaller and have a greater degree of uniformity than those used in the cushion layer 12. For example, in some embodiments, the rubber granules 31 used in the wear layer may have cross-sections between about 1 mm and about 4 mm, between about 1 mm and about 3.5 mm, etc. The wear layer 13 may also be prepared in any number of desirable colors, such as through the provision of pre-colored granules and the (typically on-site) mixing of those pre-colored granules in a desired ratio.

The wear layer 13 may be a poured-in-place material that can be blended and then installed by pouring and spreading in much the same manner as the cushion layer 12 described above. The thickness of the wear layer 13 may be selected to provide a desired degree of wear resistance.

Notably, because the wear layer 13 not only undergoes environmental wear, but also regular impacts from shoes, including high-heeled shoes, and mobility devices such as canes, crutches, walkers, and wheelchairs, the wear layer may desirably be stiffer, stronger, and more durable than a decorative cap layer found in a playground surface.

Embodiments of the impact attenuating pathway 10 also comprise a smooth transition into the adjacent ground surface 200. Due to being used outdoors, the adjacent ground surface may be natural earth and grass. Alternatively, particularly when used in associated with a garden, the adjacent ground surface may comprise loose fill material 201 such as soil, mulch, gravel, bark, or the like. In either instance, the adjacent material is worn away by the environment over time. It is important that the side edges 101, 102 of the pathway do not provide a sharp edge that could cause one to trip or the like. Accordingly, embodiments of the pathway comprise side edges 101, 102 that provide a smooth transition between the pathway and the adjacent ground surface.

In some embodiments, for instance, the side edges 101, 102 of at least a portion of the pathway 10, and optionally the side edges of each of the base layer 11, the cushion layer 12, and the wear layer 13, may be angled less than 90° with respect to the adjacent ground surface. Desirably, the side edges 101, 102 of at least a portion of the pathway 10 may be angled less than 70° with respect to the adjacent ground surface 200, alternatively less than 65° with respect to the adjacent ground surface, alternatively less than 60° with respect to the adjacent ground surface. It has presently been found that at angles greater than 60°, and in particular at angles greater than 65° or 70°, with respect to the adjacent ground surface, the transition between the side edges 101, 102 of a pathway 10 and the adjacent ground 200 may lack the requisite smoothness.

Although the angle need not be limited on the lower end, it may be desirable that the side edges 101, 102 of at least a portion of the pathway 10, and optionally the side edges of each of the base layer 11, the cushion layer 12, and the wear layer 13, be angled greater than 20° with respect to the adjacent ground surface 200. In some embodiments, the side edges 101, 102 may be angled greater than 5°, alternatively greater than 10°, alternatively greater than 20°, alternatively greater than 30° with respect to the adjacent ground surface 200. The lower the angle, the further into the adjacent ground the side edges of the pathway extend. Thus, although the smoothness of the transition to the adjacent ground is improved, lower angles may become undesirable where space is limited and/or where plant life near the pathway is desired, e.g. where the pathway is used in a garden setting.

It has presently been found that, for most installations, angles between about 20° and about 55° with respect to the adjacent ground surface provide a desirable combination of (i) a sufficiently smooth transition and (ii) a desirable footprint, though angles outside of that range may be preferred where called for by any particular installation. In some embodiments, the side edges 101, 102 of at least a portion of the pathway 10, and optionally the side edges of each of the base layer, the cushion layer, and the wear layer, may be angled between 70° and 10°, alternatively between 65° and 10°, alternatively between 60° and 10°, alternatively between 70° and 15°, alternatively, between 65° and 15°, alternatively between 60° and 15°, alternatively between 70° and 20°, alternatively, between 65° and 20°, alternatively between 60° and 20° with respect to an adjacent ground surface.

In some embodiments, the upper surface 14 of the pathway, e.g. the upper surface of the wear layer 13, may be substantially planar with the adjacent ground surface 200, i.e. at the same general elevation or raised only slightly above the adjacent ground surface. By angling the side edges 101, 102 of the pathway downward, natural and/or loose fill materials 201 may fill (or at least partially fill) the space above the sloped surface, enhancing the smooth transition to the adjacent ground.

In some embodiments, the pathway 10 may further comprise a crushed stone layer 15 below the base layer 11. Among other things, the crushed stone layer 15 provides drainage away from the pathway 10.

Example 1

Tiles having the cushion layer 12 and wear layer 13 composition according to the present disclosure were tested and found to demonstrate exceptional impact attenuation (in addition to providing the wear resistance and, when incorporated onto a base layer 11, the support necessary to operate as a pathway as described herein).

The tiles, which were 18 inch×18 inch squares consisted of a cushion layer 12 having a thickness of 2.0 inches and a wear layer 13 having a thickness of 0.75 inches, for a total tile thickness of 2.75 inches. The tiles were sent to TUV SUD America Inc. for testing in accordance with the IPEMA Impact Attenuation Test ASTM F1292-18 (Rev. 6, Effective Date 2018 Jan. 25). All surfaces were dry at the time of testing. Three samples were tested at a specified impact height of 4 feet. The testing was performed at three different measured surface temperatures: −6° C. (21.2° F.), 23° C. (73.4° F.), and 49° C. (120.2° F.). The results are shown in the tables below:

| Drop | Surface Temp | Height | HIC |
|---|---|---|---|
| 1 | −6° C. (21.2° F.) | 4 Ft. | 490 |
| 2 | −6° C. (21.2° F.) | 4 Ft. | 539 |
| 3 | −6° C. (21.2° F.) | 4 Ft. | 533 |
| | Average (of second and third drops) | | 536.0 |

| Drop | Surface Temp | Height | HIC |
|---|---|---|---|
| 1 | 23° C. (73.4° F.) | 4 Ft. | 499 |
| 2 | 23° C. (73.4° F.) | 4 Ft. | 539 |
| 3 | 23° C. (73.4° F.) | 4 Ft. | 547 |
| | Average (of second and third drops) | | 543.0 |

| Drop | Surface Temp | Height | HIC |
|---|---|---|---|
| 1 | 49° C. (120.2° F.) | 4 Ft. | 432 |
| 2 | 49° C. (120.2° F.) | 4 Ft. | 472 |
| 3 | 49° C. (120.2° F.) | 4 Ft. | 474 |
| | Average (of second and third drops) | | 473.0 |

It can be seen that the described embodiments provide unique and novel impact attenuating pathways/sidewalks 10, having a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An impact attenuating pathway system comprising:

an impact attenuating pathway having a. a firm base layer;

b. a cushion layer positioned on top of the base layer; and c. a wear layer positioned on top of the cushion layer; and a ground surface adjacent to the pathway;

wherein each of the base layer, the cushion layer, and the wear layer comprises a first side edge and a second side edge, each of the side edges being angled less than 70° and greater than 10° with respect to the ground surface adjacent to the pathway; and wherein the ground surface adjacent to the pathway comprises loose fill material that at least partially covers the first side edge and the second side edge of the pathway so that a top surface of the wear layer is substantially planar with the adjacent ground surface.

2. The impact attenuating pathway system of claim 1, wherein the pathway is configured to achieve a Head Injury Criterion (HIC) score less than 750 (at each of three temperatures: −6° C., 23° C., and 49° C.) at a cushion layer thickness of 2.0 inches or less and a wear layer thickness of 0.75 inches or less, as tested by ASTM F1292-18 at a specified impact height of 4 feet.

3. The impact attenuating pathway system of claim 1, wherein each of the first and second side edges is angled less than 60° with respect to the adjacent ground surface.

4. The impact attenuating pathway system of claim 3, wherein each of the first and second side edges is angled greater than 20° with respect to the adjacent ground surface.

5. The impact attenuating pathway system of claim 1, wherein the pathway is configured to withstand regular wear from shoes, canes, crutches, and the like over a period of at least 5 years.

6. The impact attenuating pathway system of claim 1, wherein the cushion layer has a thickness between an upper surface and a lower surface that is between 1.5 inches and 3 inches.

7. The impact attenuating pathway system of claim 1, wherein the wear layer has a thickness between an upper surface and a lower surface that is between 0.4 inches and 1 inch.

8. The impact attenuating pathway system of claim 1, wherein the base layer is concrete.

9. The impact attenuating pathway system of claim 1, wherein the cushion layer comprises a blend of a. a rubber component; and b. a binder.

10. The impact attenuating pathway system of claim 9, wherein the rubber component has a mean Shore A durometer less than 80.

11. The impact attenuating pathway system of claim 9, wherein the binder makes up between 4% and 10% of the blend.

12. The impact attenuating pathway system of claim 9, wherein the rubber component comprises rubber chunk, tire buffings, or a combination thereof.

13. The impact attenuating pathway system of 12, wherein the rubber component is at least 50% rubber chunk.

14. The impact attenuating pathway system of claim 1, wherein the wear layer comprises a blend of a. rubber granules; and b. a binder.

15. The impact attenuating pathway system of claim 14, wherein the rubber granules are sized between 1 and 4 mm.

16. The impact attenuating pathway system of claim 14, wherein the rubber granules comprise thermoplastic vulcanizates (TPV) granules.

17. The impact attenuating pathway system of claim 14, wherein the binder makes up between 15% and 25% of the wear layer blend.

18. A method of attenuating the impact of a person falling, the method comprising providing an outdoor area with the impact attenuating pathway system of claim 1.

19. The method of claim 18, wherein the outdoor area is associated with a senior or assisted living facility.

20. An impact attenuating pathway system comprising:

an impact attenuating pathway having a. a concrete base layer;

b. a cushion layer positioned on top of the base layer, the cushion layer comprising a blend of a rubber component and a binder; and c. a wear layer positioned on top of the cushion layer, the wear layer comprising a blend of rubber granules and a binder; and a ground surface adjacent to the pathway;

wherein the pathway comprises a first side edge and a second side edge, each of the side edges being angled less than 70° and greater than 10° with respect to the adjacent ground surface; and wherein the adjacent ground surface comprises loose fill material that at least partially covers the first side edge and the second side edge of the pathway so that a top surface of the wear layer is substantially planar with the adjacent ground surface.

* * * * *